United States Patent [19]

D'Urso et al.

[11] Patent Number: 4,458,971

[45] Date of Patent: Jul. 10, 1984

[54] ELECTRICAL TAB RECEPTACLE AND CONNECTOR

[75] Inventors: Gianfranco D'Urso, Turin; Giuseppe Pizzato, Veglio, both of Italy

[73] Assignee: AMP Incorporated, Harrisburg, Pa.

[21] Appl. No.: 388,288

[22] Filed: Jun. 14, 1982

[51] Int. Cl.[3] ..... H01R 13/62; H01R 11/22

[52] U.S. Cl. ..... 339/74 R; 339/217 S; 339/256 SP; 339/258 S

[58] Field of Search ..... 339/47 R, 48, 49 R, 339/74 R, 217 R, 217 S, 252 R, 256 R, 256 SP, 258 R, 258 S, 276 S, 276 T

[56] References Cited

U.S. PATENT DOCUMENTS

| | | | |
|---|---|---|---|
| Re. 30,277 | 5/1980 | Simmons | 339/74 R |
| 2,625,578 | 1/1953 | Dupre | 173/363 |
| 3,853,389 | 12/1974 | Occhipinti | 339/258 R X |
| 3,976,348 | 8/1976 | Simmons | 339/74 R |
| 4,067,633 | 1/1978 | Groft et al. | 339/74 R |
| 4,209,220 | 6/1980 | Szablowski | 339/258 R X |

FOREIGN PATENT DOCUMENTS

| | | |
|---|---|---|
| 005370 | 5/1979 | European Pat. Off. . |
| 0024981 | 8/1980 | European Pat. Off. . |
| 2505099 | 5/1982 | France . |

*Primary Examiner*—Eugene F. Desmond
*Assistant Examiner*—Steven C. Bishop
*Attorney, Agent, or Firm*—Robert W. J. Usher

[57] ABSTRACT

An electrical tab receptacle (2) formed from sheet metal has a box-like body (3) with spring arms (7, 8) extending forwardly in convergent manner and having turned out ends (9, 10) defining a divergent entry to a tab receiving space. A latch projection (13) is formed on one arm (8) and presents a rear-facing shoulder in the tab receiving space, arranged to engage a tab recess or aperture (16) of a complementary tab to resist withdrawal of the tab (17) from the receptacle. Outward flexure of the arm (8) serves to release the latch projection (13) and the receptacle (2) is suitably mounted in a housing (1) with the capacity for limited movement in the tab receiving direction between forward and rearward housing shoulders (11, 6). The forward shoulder (11) is formed on its rearward face with a ramp (12) adapted to deflect the arm (8) transversely outwards on rearward movement relative to the receptacle.

7 Claims, 5 Drawing Figures

FIG.3.
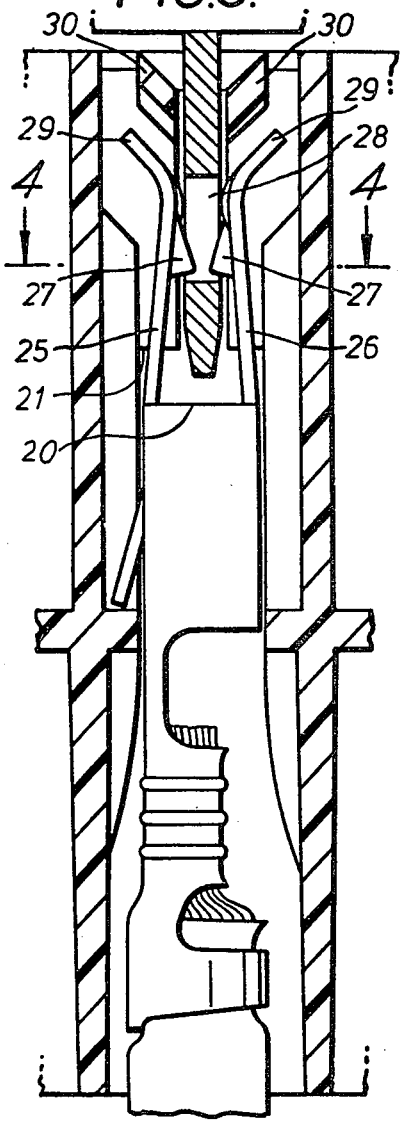
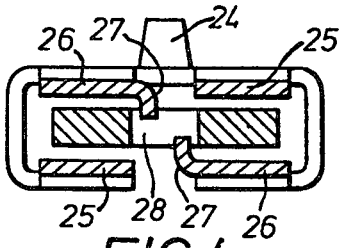
FIG.4.
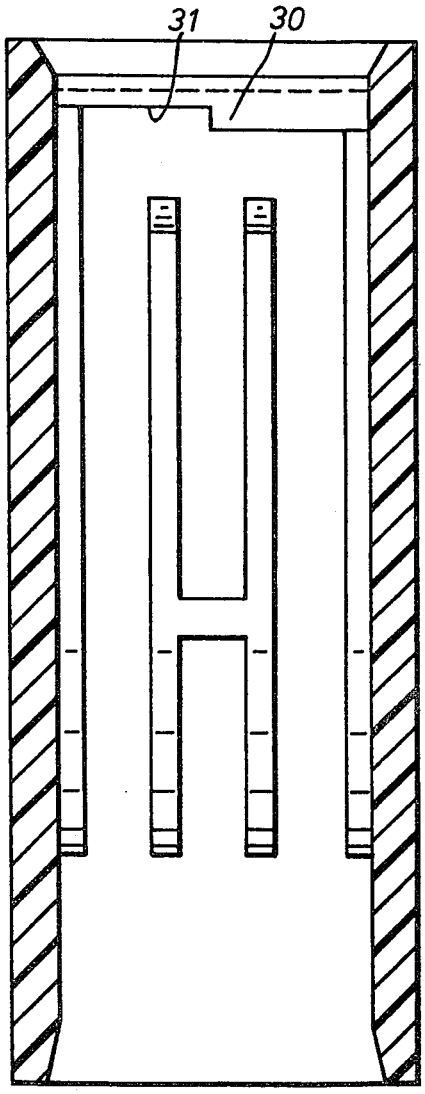
FIG.5.

ELECTRICAL TAB RECEPTACLE AND CONNECTOR

This invention relates to an electrical tab receptacle having a latch adapted positively to lock in an aperture in the tab to resist inadvertent separation of the tab and receptacle.

In our U.S. Pat. Nos. 3,976,348 and Re. 30277, we have disclosed a tab receptacle comprising a generally channel-shaped receptacle portion having a base and upstanding side-walls with free edge portions of the side-walls turned in over the base for receiving a complementary tab between the turned in edges of the side-walls and an integral tongue extending from the base within the receptacle portion, the free end of the tongue projecting externally of the receptacle, and the tongue, within the receptacle portion being formed with a lance arranged and adapted to engage a corresponding recess or aperture in a complementary tab for positively locking the receptacle against withdrawal from the tab. In such arrangement the receptacle may be disengaged by depressing the exposed free end of the tongue, and in one embodiment the receptacle is contained within a housing capable of limited relative movement to the receptacle whereby a pull on the housing will actuate the housing to depress the free end of the tongue.

Tab receptacles of this kind have met with substantial commercial success, particularly in automotive applications, where the integrity of the electrical circuitry has been substantially improved. However, the use of such receptacles is limited to connectors having relatively few receptacles, and in which the alignment between the tabs and receptacles is relatively precise.

It is an object of the invention to obtain the advantageous positive locking feature in receptacles having a wider application and capable of providing low frictional forces on engagement and disengagement such that they can conveniently be employed in multi-way connectors.

An electrical tab receptacle according to the present invention is formed from sheet metal with a box-like body of generally rectangular section and open at an end, the body having spring arms extending forwardly from a pair of opposite sides at that end, the spring arms converging forwardly, and an end of at least one arm being bent outwardly to define a divergent entrance to a tab receiving space between the arms, a latch projection being formed on one of the spring arms presenting a rear-facing shoulder in the tab receiving space arranged to engage a recess or aperture in a tab when received between the opposed spring arms.

Suitably the latch projection is formed on an arm having an outwardly bent end portion and preferably all of the arms have outwardly-bent end portions to facilitate tab entry.

The bent out portion of the arm having the latch projection suitably provides a release member for disengaging the latch. The receptacle may be mounted in a housing adapted for limited movement relative to the receptacle and formed with a projection arranged to engage the bent out end portion of the latch spring arm on relative rearward movement to effect release.

The box-like body is suitably of open-seam form, the seam extending between ends at one side, and a pair of spring arms extending forwardly from that side, one on each side of the seam. At the other side there may be a single spring arm of width corresponding to the overall width of the pair, formed centrally with the latch projection. Suitably the wide arm is formed rearwardly of the latch projection with an aperture extending rearwardly towards the body.

Alternatively a pair of spring arms may be formed at both sides and in such an arrangement latch projections may be formed on one arm of each pair at opposite sides relatively, so that the projections engage the tab aperture at opposite sides and do not interfere. The latch projections may suitably be formed by lateral projections from inner sides of the arms which are bent into the tab receiving space.

The invention will now be described, by way of example, with reference to the accompanying drawings, in which:

FIG. 3 is a fragmentary sectional elevation of a modified connector;

FIG. 4 is a section taken on the line 4—4 of FIG. 3 but with the connector housing omitted; and FIG. 5 is a sectional elevation of the housing of the connector of FIG. 3 viewed from the right of that figure.

Figure 1:
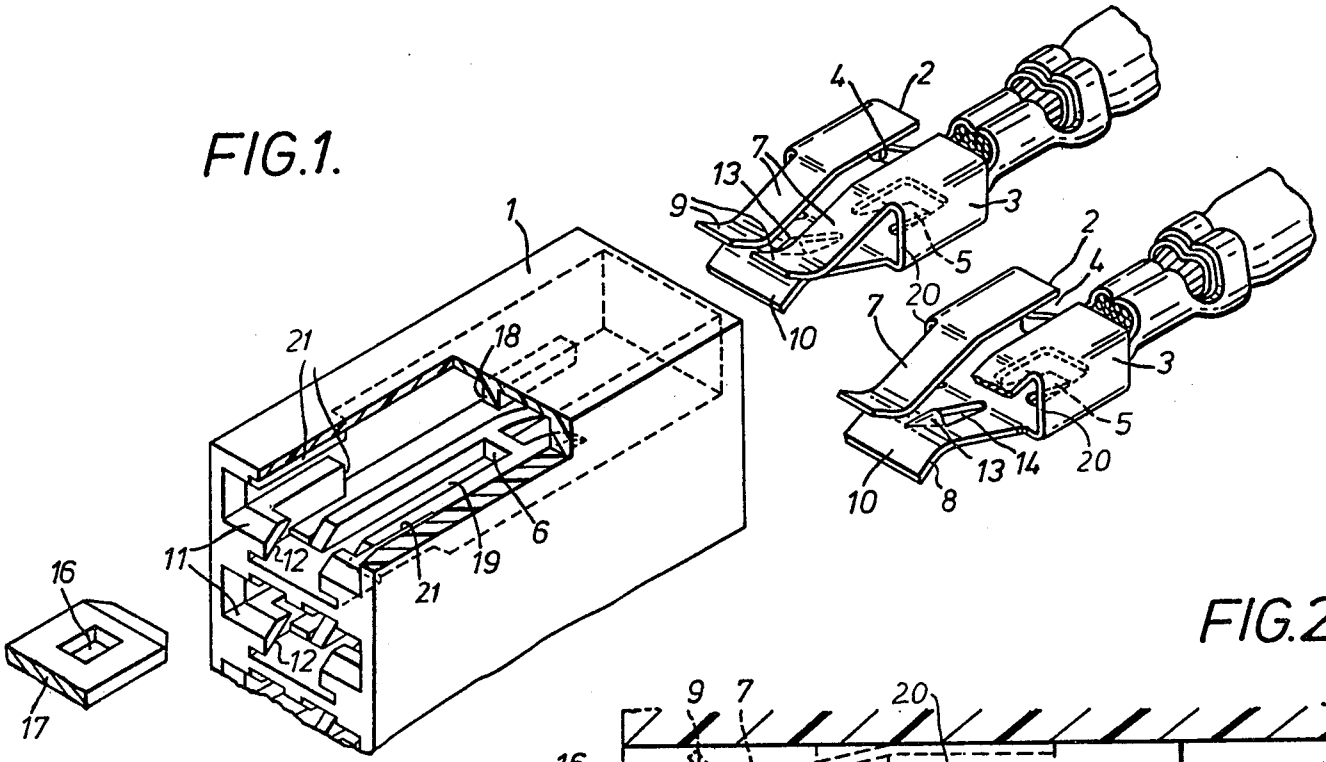
FIG. 1 is a fragmentary exploded view of a multi-way connector according to one embodiment.
Figure 2:
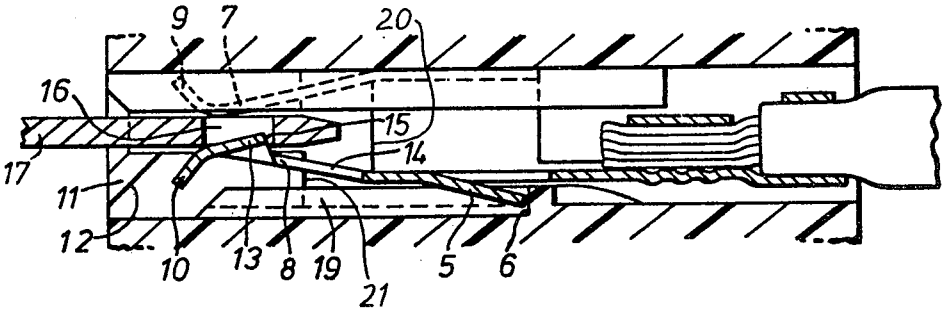
FIG. 2 is a fragmentary sectional view of part of the connector of FIG. 1.

In the embodiment of FIGS. 1 and 2, a multi-way connector housing 1 has a plurality of cavities for tab receptacles 2. Each receptacle 2 comprises a box-like body 3 having an open seam 4 and at a rear end being integrally formed with a crimping portion secured to a conductor wire. The body 3 is formed on the side opposite the seam 4 with a latch 5 for releasably securing the receptacle in the housing by engagement with a forward facing shoulder 6. At the forward end the body 3 is formed at the seam side with a pair of spring arms 7, and at the opposite side with a single, wider spring arm 8, the spring arms 7, 8 converging forwardly to define a tab receiving space, and at their forward ends 9, 10 being turned out in divergent manner to define a tab entrance. The forward end 10 of the wider arm 8 is adapted to engage a projection 11 at the forward end of the housing cavity, the projection having an inclined surface 12 adapted, on rearward movement relative to the receptacle 2, to engage the forward end 10, and cam the spring arm 8 outwards.

The wider spring arm 8 is formed with a latch 13, forwardly of an aperture 14, and presenting a rear facing shoulder 15 adapted to engage an aperture 16 formed in the complementary tab 17. The aperture 14 extends rearwardly towards the body 3, opposite the seam 4, and serves substantially to balance the spring characteristics of spring arm 8 in relation to the arms 7.

The receptacle 2 is assembled into the housing with a rib 18 of the housing 1 engaging the body seam 4, the latch 5 engaging shoulder 6 and positioned in a forwardly extending housing slot 19. Shoulders 20 at opposite sides of the forward end of the receptacle body 3 are spaced rearwardly of housing shoulders 21, whereby relative movement of the housing 1 rearwardly of the receptacle 2 is possible in order to engage the housing projections 12 with the spring ends 10 for release of the latch projections 13 from the tab apertures 16 by cam action as has been described.

In the embodiment of FIGS. 3 and 4 the receptacle is of generally similar form having a box-like body formed with a latch 24 but it is formed with a pair of spring arms 25, 26 at both of a pair of opposite sides of the box.

One arm 26 of each pair is formed, at a side adjacent the other arm 25, with a tongue 27, of generally triangular form and bent inwardly to define a rear facing shoulder for locking engagement in a tab aperture 28. The arms 26 are diagonally opposed as seen in FIG. 3, so that the locking tongues 27 are disposed at opposite sides of the tab aperture 28, and do not interfere.

Forward ends 29 of the spring arms are turned out, and the housing for the receptacle is suitably provided with projections 30, similar to those 11 of the first embodiment, at opposite sides of the receptacle cavity to engage both spring arms 26 on relative rearward movement, to effect outward flexure and release of the locking tongues from the tab aperture 28.

As seen in FIG. 5, the projections 30 are suitably recessed at sides 31 adjacent ends of arms 25, so that the projections only act on the arms 26 on the rearward movement of the housing relative to the receptacle.

What is claimed is:

1. An electrical tab receptacle formed from sheet metal with a box-like body of generally rectangular section and open at an end, the body having spring arms extending forwardly from a pair of opposite sides at that end, the spring arms converging forwardly, and an end of at least one arm being bent outwardly to define a divergent entrance to a tab receiving space between the arms, characterised in that the box-like body (3) is of open-seam form, the seam (4) extending between ends at one side, and a pair of spring arms (7) extending forwardly from that side, one on each side of the seam (4) and at the other side a single spring arm (8) of width corresponding to the overall width of the pair (7), the single spring arm (8) having an outwardly bent end portion (10) and being formed centrally with a latch projection (13) which presents a rear-facing shoulder (15) in the tab receiving space arranged to engage a recess or aperture (16) in a tab (17) when received between the opposing spring arms (7, 8) to resist withdrawal, the single spring arm (8) also being formed with an aperture (14) extending rearwardly of the latch projection (13), to the body (14).

2. A tab receptacle as claimed in claim 1 mounted in a housing cavity and retained between forward and rearward housing shoulders arranged to permit limited relative movement between the housing and the receptacle in the tab receiving direction, characterised in that the forward shoulder (11) is formed on its rear face (12) with a ramp arranged to engage the arm (8) of the receptacle on relative rearward movement of the housing, to bias the arm (8) with its latch projection (15) transversely outwardly.

3. An electrical tab receptacle formed from sheet metal with a box-like body of generally rectangular section and open at an end, the body having spring arms extending forwardly from a pair of opposite sides at that end, the spring arms converging forwardly, and an end of at least one arm being bent outwardly to define a divergent entrance to a tab receiving space between the arms, characterised in that pairs of spring arms (25, 26) are formed at opposite sides of the body and a latch projection (27) is formed on one arm of each pair and presents a rear-facing shoulder in the tab receiving space arranged to engage a recess or aperture (28) in a tab (17) when received between the opposing spring arms (25, 26) to resist withdrawal, the latch projections (27) being on opposite sides relatively of the tab receiving space so that the projections (27) engaged the tab aperture (28) at opposite sides and do not interfere.

4. A tab receptacle as claimed in claim 3, characterised in that the latch projections (27) are formed by lateral projections extending from inner sides of the arms (26) and which are bent into the tab receiving space.

5. A tab receptacle as claimed in claim 4 or claim 3 mounted in a housing cavity and retained between forward and rearward housing shoulders arranged to permit limited relative movement between the housing and the receptacle in the tab receiving direction, characterised in that the forward shoulder (11) is formed on its rear face (12) with a ramp arranged to engage the arms (26) of the receptacle on relative rearward movement of the housing, to bias the arms (26) with its latch projection (27) transversely outwardly.

6. A tab receptacle and housing as claimed in claim 5, characterised in that the housing is formed with forward shoulders (30) at opposite sides of the cavity, arranged to engage arms (26) at opposite sides of the receptacle, the shoulders (30) being recessed adjacent the arms (25) so that only the arms (26) formed with latch projections (27) are flexed transversely outwards on relative rearward movement of the housing.

7. A tab receptacle as claimed in claim 5, characterized in that each arm (25, 26) formed with a latch projection (27) has an outwardly bent end portion (29).

* * * * *